US005565291A

United States Patent [19]

Mayama et al.

[11] Patent Number: 5,565,291

[45] Date of Patent: Oct. 15, 1996

[54] CARRIER FOR USE IN ELECTROPHOTOGRAPHY AND TWO COMPONENT-TYPE DEVELOPER CONTAINING THE CARRIER

[75] Inventors: Shinya Mayama, Yamato; Yuko Sato, Kawasaki, both of Japan

[73] Assignee: Canon Kabushiki Kaisha, Tokyo, Japan

[21] Appl. No.: 217,964

[22] Filed: Mar. 25, 1994

[30] Foreign Application Priority Data

Mar. 25, 1993 [JP] Japan ..... 5-089476
Mar. 25, 1993 [JP] Japan ..... 5-089477

[51] Int. Cl.[6] ..... G03G 9/10

[52] U.S. Cl. ..... 430/106.6; 430/108; G03G/9/10

[58] Field of Search ..... 430/106.6, 66, 430/110, 109, 108

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 3,781,378 | 12/1973 | Kentor et al. | 260/824 R |
| 4,071,361 | 1/1978 | Marushima | 96/1.4 |
| 4,758,491 | 7/1988 | Alexandrovich et al. | 430/110 |
| 5,021,317 | 6/1991 | Matsubara | 430/110 |
| 5,213,928 | 5/1993 | Yu | 430/66 |

FOREIGN PATENT DOCUMENTS

| | | | |
|---|---|---|---|
| 48-64199 | 9/1973 | Japan | C08G 31/09 |
| 56-66134 | 6/1981 | Japan | H02J 3/00 |
| 61-6959 | 1/1986 | Japan | H04M 1/03 |

*Primary Examiner*—John Goodrow
*Attorney, Agent, or Firm*—Fitzpatrick, Cella, Harper & Scinto

[57] ABSTRACT

A two-component type developer for developing an electrostatic image is constituted by a toner and a carrier. The carrier is composed of a magnetic material and a resin either coating or dispersing the magnetic material. The resin comprises a copolymer having structural units of the following formulae [1] and [2]:

[1]

wherein A denotes a $C_1$–$C_{10}$ linear, branched or cyclic alkylidene group, aryl-substituted alkylidene group or arylenedialkylidene group, —O—, —S—, —CO—, —SO— or —$SO_2$—; and $R_1$–$R_4$ independently denote hydrogen, halogen, or a $C_1$–$C_4$ alkyl or alkenyl group:

[2]

wherein $R_5$ denotes a $C_2$–$C_6$ alkylene or alkylidene group; $R_6$ and $R_7$ denote a $C_1$–$C_3$ alkyl group, a phenyl group or a substituted phenyl group; and n is an integer of 1–200.

56 Claims, 2 Drawing Sheets

CARRIER FOR USE IN ELECTROPHOTOGRAPHY AND TWO COMPONENT-TYPE DEVELOPER CONTAINING THE CARRIER

FIELD OF THE INVENTION AND RELATED ART

The present invention relates to a carrier for use in electrophotography, and a two component-type developer containing the carrier and a toner for developing electrostatic images.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner having a polarity of charge opposite to that of the latent image is attached onto the latent image to develop the latent image. Subsequently, the resultant toner image is, after being transferred onto a transfer material such as paper, as desired, fixed, e.g., by heating, pressing, or heating and pressing, or with solvent vapor to obtain a copy.

In the step of developing the latent image, toner particles charged to a polarity opposite to that of the latent image are attracted by electrostatic force to attach onto the latent image. Alternatively, in case of reversal development, toner particles having a triboelectric charge of the same polarity as that of the latent image are used. In general, methods for developing an electrostatic latent image with a toner can be classified into a developing method using a two component-type developer constituted by mixing a small amount of a toner with carrier and a developing method using a mono-component-type developer constituted by a toner alone without containing a carrier.

The carrier constituting the two component-type developer may generally be classified roughly into an electroconductive carrier and an insulating carrier.

The electroconductive carrier may generally comprise oxidized or yet-unoxidized iron powder. The two component-type developer comprising iron powder carrier is accompanied by problems in that the triboelectric chargeability of the toner is liable to be unstable and the resultant visible image formed by the developer is liable to be accompanied by fog. Further, along with continual use of the developer, toner particles adhere onto the surface of the iron powder carrier particles to increase the electrical resistivity of the carrier particles, so that the bias current decreases and the triboelectric charge is destabilized. As a result, the formed toner image is liable to have a lower image density and be accompanied by increased fog.

The insulating carrier representatively comprises a core material of a ferromagnetic material, such as iron, nickel or ferrite, uniformly coated with an insulating resin. The developer using this type of carrier is advantageous in that the adhesion of toner particles onto the carrier surface is remarkably less than in the case of the electroconductivity, and the developer is excellent in durability and has a long service life, so that the developer is particularly suitable for a high-speed electrophotographic copying machine.

Such an insulating carrier is required to satisfy several requirements inclusive of: a durability that the coating layer covering the carrier core shows a sufficient wear resistance and a strong adhesion onto the core, an anti-soiling characteristic that the coating layer shows a good sticking prevention effect so as to prevent filming of the toner material on the carrier surface and a charging characteristic that a specific toner used in combination with the carrier is provided with a triboelectric charge of a desired polarity through friction with the carrier. The carrier particles are subjected to friction with the other carrier particles and toner particles within a developing device and, if the carrier coating surface is covered with a film of the attached toner, the charging characteristic becomes unstable.

In order to prevent the soiling with a toner, it has been hitherto proposed to coat the carrier surface with various resins.

For example, a carrier coated with a fluorine-containing resin, such as a tetrafluoroethylene copolymer has a low critical surface tension so that the toner soiling does not readily occur, but is poor in film forming characteristic so that it becomes difficult to sufficiently uniformly coat the carrier core and it is difficult to obtain a stable charging characteristic. The fluorine-containing resin also shows a poor adhesion with the core material and is liable to provide an insufficient wear resistance. Further, because of its position in the triboelectrification series, a fluorine-containing resin-coated carrier cannot provide a sufficient negative charge to a toner.

On the other hand, a carrier coated with an acrylic resin, such as a styrene-methacrylate copolymer, shows good film-forming characteristic and good adhesion onto the core of the coating film. However, an acrylic resin shows a relatively high critical surface tension and is liable to suffer from soiling with toner on repetitive use, thus leaving some problem in respect of the life of the developer. Further, the wear resistance thereof is not sufficiently high while its surface hardness is relatively high.

A silicone resin has a low surface energy and can decrease the soiling with toner, but shows a rather low mechanical strength so that the coating layer composed thereof is liable to be worn out while being stirred within the developing device. Thus, it is difficult to provide a stable charging characteristic. It is possible to use a polymer having a polydialkylsiloxane structure unit in admixture with another polymer, such as a styrene-acrylate copolymer. In this case, however, the polydialkylsiloxane-containing polymer is condensed at the surface and is liable to be preferentially lost during stirring within the developing device, so that it becomes difficult to stabilize the charging characteristic over a long period.

Accordingly, it is still desired to develop a carrier for a two-component type developer, capable of showing a satisfactory charging characteristic, excellent soiling resistance and good successive copying characteristic on a large number of sheets and also capable of providing high-quality toner images.

A two-component type developer comprising a toner and a magnetic carrier is applied in a prescribed coating layer thickness by a developer layer thickness-regulating member on a developing sleeve enclosing a magnet inside thereof and conveyed by a magnetic force to a developing zone formed between a photosensitive member and the developing sleeve.

Between the photosensitive member and the developing sleeve, a prescribed developing bias voltage is applied so as to develop an electrostatic latent image with a toner in the developing zone.

As important requirements, the magnetic carrier is required to show appropriate charging characteristic, withstand voltage resistant to an applied voltage, impact resistance, wear resistance, anti-spent characteristic, developing characteristic and productivity.

Regarding the anti-spent characteristic, for example, in the case of a continual use of a developer for a long period, a so-called "spent toner" (a filming or melt-sticking of a toner) is attached onto the carrier surface, thus resulting in a deterioration of the developer and thus an image quality deterioration of the developed images.

Generally, in case where a carrier has too large a specific gravity, a large load is applied onto the developer at the time of applying the developer in a prescribed layer thickness on the sleeve by the above-mentioned developer layer thickness-regulating means or at the time of stirring the developer within the developing device, so that (a) toner filming and (a) toner deterioration are liable to be caused during the long use of the developer, thus causing deterioration of the developer and image quality deterioration of the developed images. A developer containing a carrier liable to cause the above difficulties (a) and (b) requires a periodical exchange thereof or improvement of the carrier regarding the durability and anti-spent characteristic so as to alleviate the difficulties (a) and (b), thus prolonging the life of the developer.

In order to cope with the above problems, it is possible to use a carrier comprising magnetic particles dispersed within a binder resin, e.g., a magnetic material-dispersion type carrier produced by pulverization, e.g., as proposed in Japanese Laid-Open Patent Application (JP-A) 54-66134.

It is also possible to use a magnetic material-dispersion type carrier produced by polymerization disclosed by JP-A 61-6959.

However, the above-mentioned magnetic material-dispersion type developers are accompanied by a difficulty that, unless a large amount of magnetic material is incorporated in a carrier particle, the carrier shows a small saturation magnetization relative to the particle size and is liable to attach to the photosensitive member at the time of developing. As a result, it is necessary to install mechanisms for replenishing the developer and recovering the attached carrier within the image forming apparatus. Thus, the magnetic material-dispersion type carrier is not sufficiently satisfactory as a measure for prolonging the life of the developer.

On the other hand, in case where a large amount of magnetic material is incorporated in the above-mentioned magnetic material-dispersion type carrier, the magnetic material having a low resistivity is increased in amount to be exposed to the carrier surface to lower the resistivity of the carrier, so that the resultant image quality is liable to be lowered due to leakage of the bias voltage applied during the development.

Further, in the case where a large amount of magnetic material is incorporated in the magnetic material-dispersion type carrier, the amount of the magnetic material is increased relative to the binder resin to make the carrier less resistant to a mechanical impact, so that the magnetic material is liable to drop off the carrier at the time of applying the developer in a prescribed layer thickness on the sleeve by the developer layer thickness-regulating means. As a result, the developer is liable to be deteriorated again.

Further, the fine particles which result after the dropping or breakage of the magnetic material have a low magnetic property so that they cannot be held on the sleeve at the time of development to attach to the photosensitive member, thus generating image defects.

As the binder resin for dispersing magnetic material particles to produce a magnetic material-dispersion type carrier, various resins have been known and used, such as acrylic resin, vinyl resin, styrene-acrylate copolymer, styrene-butadiene copolymer, ethylene-vinyl acetate copolymer, and further, polyester resin, epoxy resin, phenolic resin, urea resin, polyurethane resin, polyimide resin, cellulosic resin, low-molecular weight polypropylene, vinyl chloride resin, vinyl acetate resin, copolymers of these resins, and petroleum resin.

However, a resinous carrier composition utilizing a binder resin as described above in admixture with a magnetic material causes a decrease in impact resistance and wear resistance particularly when used for a long period. Such a binder resin is therefore liable to cause the breakage or wearing of the carrier per se, thus failing to show a sufficient charging characteristic and also resulting in fine carrier particles which adhere to the photosensitive member during development and cause fog at the non-image parts of the developed images. In addition, as the carrier binder resin has a relatively close chemical composition to a toner binder resin (e.g., styrene-butadiene copolymer, styrene-acrylate copolymer or polyester resin), the toner readily adheres to the carrier to change and/or lower the triboelectric charging ability, so that it is difficult to provide a two-component type developer which provides high-quality images, and is excellent in successive image formation characteristic and highly stable.

In order to alleviate the above problems, it is possible to use a curable resin, such as epoxy resin, but the use of a curable resin is accompanied by a problem that a foreign matter is rather accumulated on the surface to result in a remarkable change in triboelectric charging characteristic.

Accordingly, in order to realize a magnetic material-dispersion type carrier containing an increased amount of magnetic material, it has been considered necessary to use a binder resin which shows a good adhesion to the magnetic material and also a good dispersion of the magnetic material.

Thus, a magnetic material-dispersion type carrier showing good soiling resistance and durability suitable for successive image formation on a large number of sheets has been desired.

SUMMARY OF THE INVENTION

A generic object of the present invention is to provide a carrier for use in electrophotography (hereinafter sometimes referred to as "electrophotographic carrier" or simply "carrier") having solved the above-mentioned problems.

A more specific object of the present invention is to provide an electrophotographic carrier which is excellent in wear resistance and impact resistance.

Another object of the present invention is to provide an electrophotographic carrier which is not readily stained or soiled by the toner.

Another object of the present invention is to provide an electrophotographic carrier coated with a highly durable resin which has sufficient mechanical strength against wearing and impact.

Another object of the present invention is to provide a resin-coated electrophotographic carrier which is excellent in surface releasability, less susceptible to soiling with the toner and is excellent in stability.

Another object of the present invention is to provide a magnetic material dispersion-type electrophotographic carrier less susceptible to soiling with the toner.

Another object of the present invention is to provide a magnetic material dispersion-type electrophotographic carrier excellent in wear resistance and impact resistance.

Another object of the present invention is to provide a magnetic material dispersion-type electrophotographic carrier which is less liable to stick to a photosensitive member.

A further object of the present invention is to provide a two-component type developer capable of providing high-quality toner images.

Another object of the present invention is to provide a two-component type developer excellent in successive image forming characteristic on a large number of sheets.

According to the present invention, there is provided a carrier for use in electrophotography, comprising a magnetic material and a resin, said resin comprising a copolymer having structural units of the following formulae [1] and [2]:

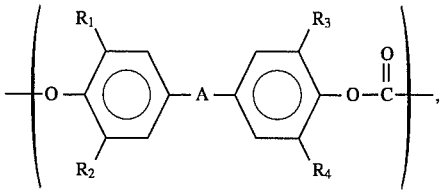

[1]

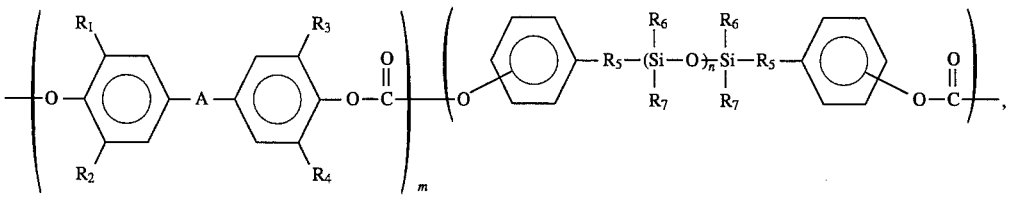

[3]

wherein A denotes a $C_1$–$C_{10}$ linear, branched or cyclic alkylidene group, aryl-substituted alkylidene group or arylenedialkylidene group, —O—, —S—, —CO—, —SO— or —$SO_2$—; and $R_1$–$R_4$ independently denote hydrogen, halogen, or a $C_1$–$C_4$ alkyl or alkenyl group;

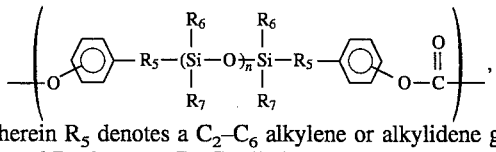

[2]

wherein $R_5$ denotes a $C_2$–$C_6$ alkylene or alkylidene group; $R_6$ and $R_7$ denote a $C_1$–$C_3$ alkyl group, a phenyl group or a substituted phenyl group; and n is an integer of 1–200.

According to another aspect of the present invention, there is provided a two-component type developer for developing an electrostatic image, comprising a toner and the above-mentioned carrier.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
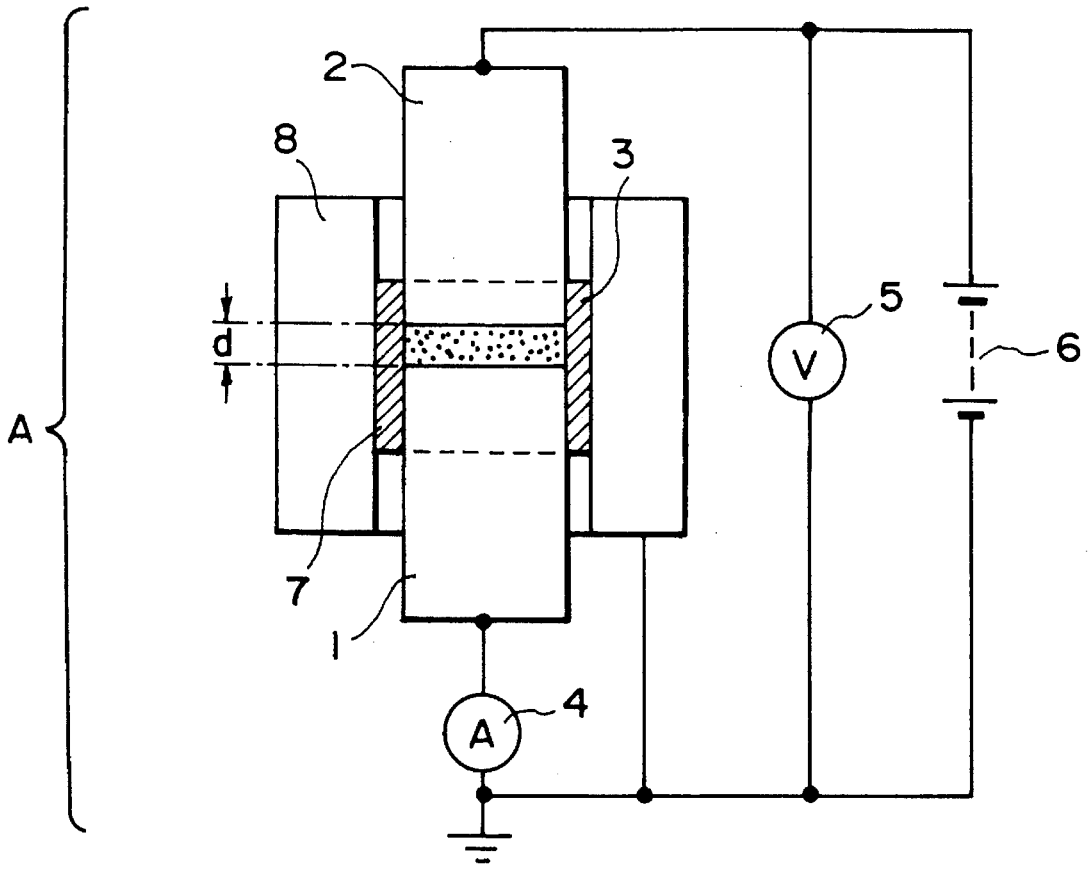
FIG. 1 is a schematic view showing an apparatus for measuring an electrical resistivity of a carrier.

In the present invention, a copolymer showing an improved surface releasability without causing a lowered carrier strength is used as a carrier-forming material in order to provide a highly durable and highly stable carrier having solved the above-mentioned problems.

The copolymer used in the present invention is characterized by having a polycarbonate unit providing a good impact resistance and a polydialkylsiloxane unit and is provided with an improved surface lubricity while retaining the impact resistance.

More specifically, the copolymer used in the present invention is characterized by having a structural unit of the formula [1] and a structural unit of the formula [2] described above and may preferably be in the form of a block copolymer having at least one block copolymer unit including a polycarbonate unit and a polysiloxane unit and represented by the following formula [3]:

wherein $R_1$–$R_4$ and A have the same meanings as in the formula [1]; $R_5$–$R_7$ and n have the same meanings as in the formula [2]; and m is a positive integer. The number n in the structural unit [2] may preferably be in the range of 10–150. The block copolymer may preferably comprise 99.9–50 wt. % of the polycarbonate unit and 0.1–50 wt. % of the polysiloxane unit so as to provide a good balance among impact resistance, charging characteristic (property of imparting a triboelectric charge to the toner) and lubricity.

The structural unit [1] of the copolymer may be derived, e.g., from a diol represented by the following formula:

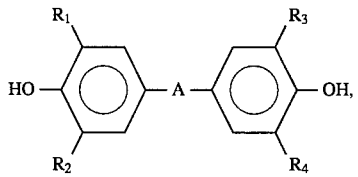

[1A]

wherein $R_1$–$R_4$ and A respectively have the same meanings as in the formula [1].

Further, the structural unit [2] of the copolymer may be derived, e.g., from a polysiloxanediol represented by the following formula [2A]:

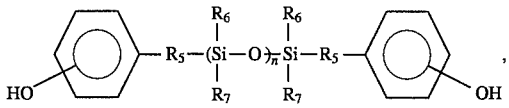

[2A]

wherein $R_5$–$R_7$ have the same meanings as in the formula [2] and n may preferably be 10–50.

Some examples of diphenol compounds providing the polycarbonate unit (structural unit [1]) of the copolymer are enumerated below, but they are not exhaustive:

No. 1
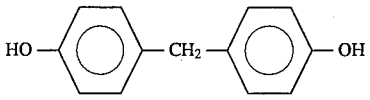
No. 2
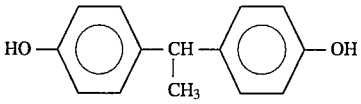
No. 3
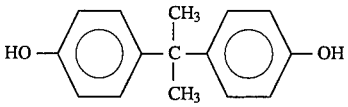
No. 4
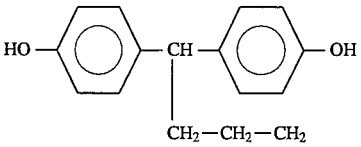
No. 5
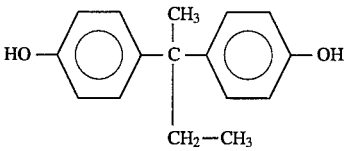
No. 6
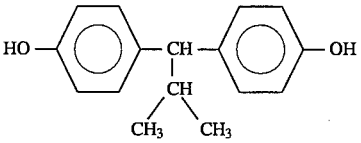
No. 7
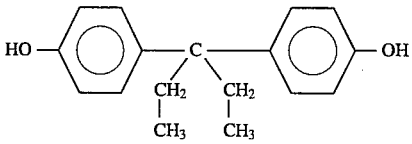
No. 8
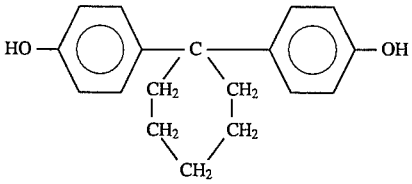
No. 9
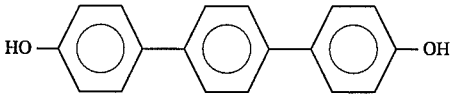
No. 10
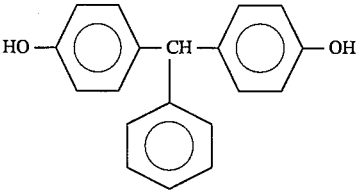
-continued
No. 11
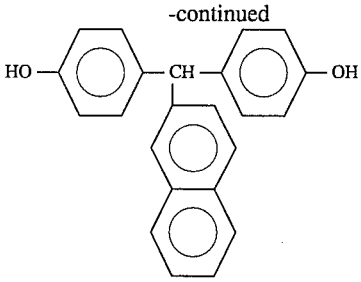
No. 12
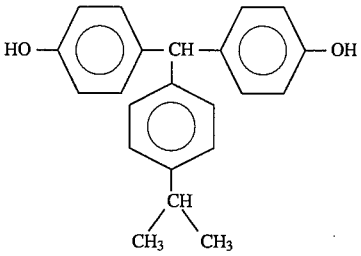
No. 13
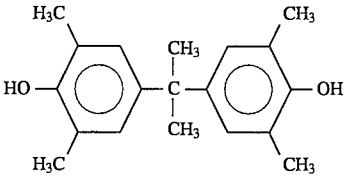
No. 14
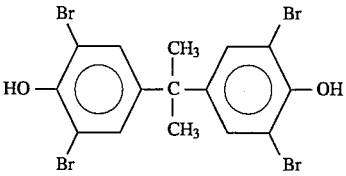
No. 15
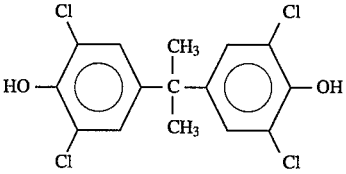
No. 16
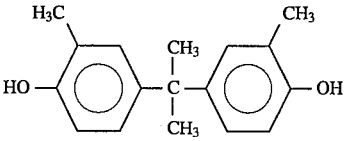
No. 17
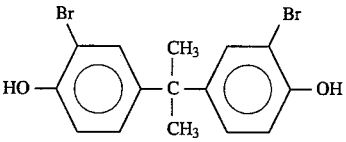
No. 18
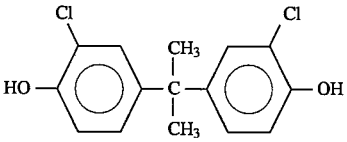
No. 19
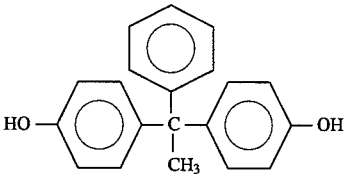

-continued
No. 20
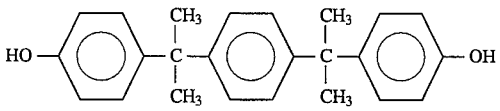
No. 21
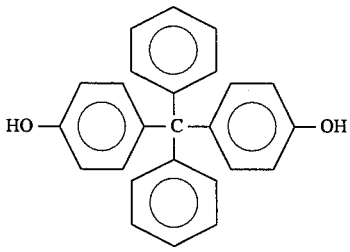
No. 22
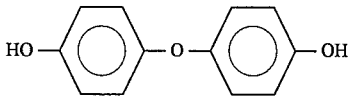
-continued
No. 23
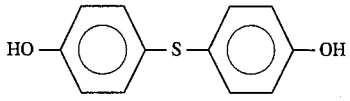
No. 24
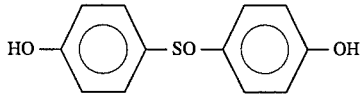
No. 25
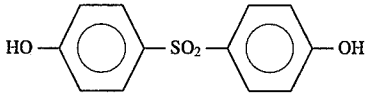
No. 26
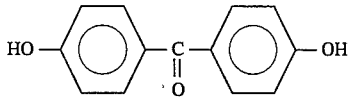
Among the above, Compounds Nos. 3, 8, 16, 19 and 21 are especially preferred.
Next, some preferred examples of polyorganosiloxanes giving the structural unit [2] of the copolymer are enumerated below, but they are not exhaustive:
No. 27
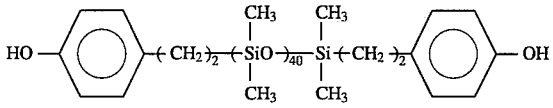
No. 28
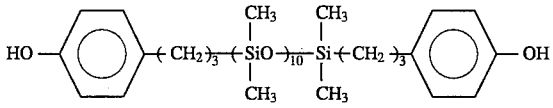
No. 29
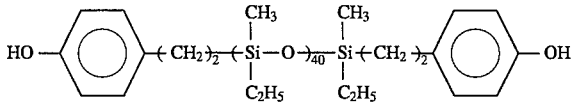
No. 30
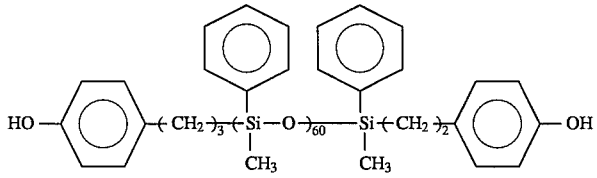
No. 31
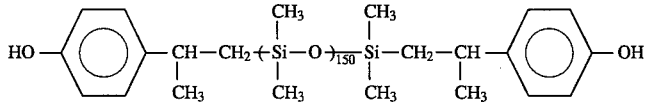
No. 32
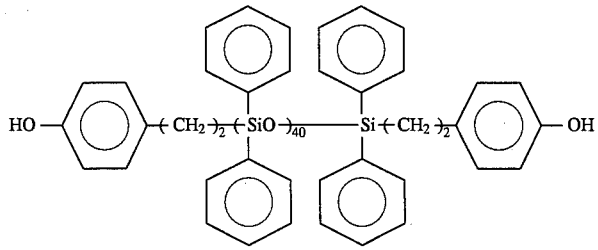
No. 44
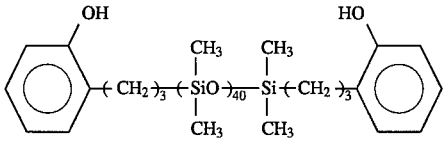

-continued

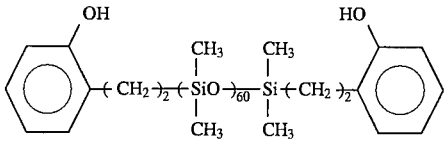

No. 45

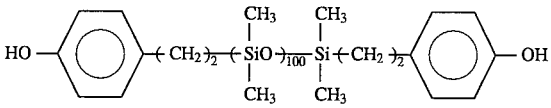

NO. 46

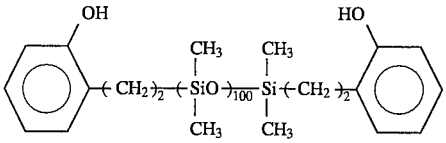

NO. 47

The copolymer used in the present invention may be synthesized by polymerization using a diol and a polyorganosiloxane as described above through the phosgene process, the ester exchange process or the chloroformate intermediate process. It is suitable to apply polymerization according to the phosgene process in a solution system in order to stabilize the randomness of the copolymerization. It is possible to apply, e.g., a process disclosed in U.S. Pat. No. 3,781,378 (corr. to JP-A 48-64199) in order to produce a polycarbonate block copolymer.

The copolymer used in the present invention may preferably have a weight-average molecular weight of 10,000–100,000 in view of the wear resistance and durability.

The carrier of the present invention may suitably have an average particle size (diameter) of 5–100 μm. If the carrier particle size is below 5 μm, the carrier is liable to attach to the photosensitive member. In excess of 100 μm, a large shearing force is applied to the developer within the developing device, thus being liable to cause deterioration of the developer, particularly separation of external additive from the toner and shape change of the toner. Too large a particle size provides a smaller specific surface area, so that a smaller amount of toner is retained by the carrier, thus being liable to provide images with lower definition.

In the two-component type developer of the present invention, it is preferred to select a combination of a carrier and a toner so as to provide a toner triboelectric charge of 5–50 μc/g in terms of an absolute value through friction between the carrier and the toner.

Hereinbelow, a case of using the copolymer as a coating material on a magnetic carrier core and a case of using the copolymer as a binder resin for a magnetic material-dispersion type carrier will now be described in further detail.

In the case of using the copolymer as a coating material on a carrier core, the carrier surface releasability is improved so that it is possible to effectively prevent the lowering in carrier life due to the soiling with the toner. Further, the coating solution can be uniformized to prevent a lowering in strength of the carrier coating layer, thus providing an improved durability. As a result, a developer comprising the carrier of the present invention is excellent in successive copying characteristic and stability. It is generally preferred that the copolymer has a higher glass transition point so as to provide an improved thermal stability.

The copolymer used in the present invention can provide a clear solution when dissolved in a solvent, thus providing a sufficiently tough resin coating. This is particularly true when a dialkylsiloxane-block diphenol compound of the above formula [2A] is used for copolymerization so as to effect the copolymerization in a sufficiently random manner. This is presumably effective in preventing the growth of a long chain polydialkylsiloxane block leading to a lower solubility and a turbid solution. Further, it is also possible to prevent the formation of a polymer chain of polydialkylsiloxane alone, thus providing a copolymer showing stable properties.

Such a coated carrier may be formed, e.g., by dissolving the copolymer in an appropriate solvent including, e.g., an aromatic solvent, such as benzene, toluene or xylene; a halogenated compound, such as dichloromethane, trichloromethane or chlorobenzene; or a cyclic ether, such as tetrahydrofuran, tetrahydropyrane or dioxane, applying the resultant solution onto the surfaces of the magnetic carrier core particles, and drying the resultant coating solution film to form a resin film on the magnetic carrier core surfaces.

The polycarbonate-polysiloxane block copolymer may preferably have a weight-average molecular weight of 10,000–100,000. If the molecular weight is below 10,000, the durability is liable to be lowered. If the molecular weight exceeds 100,000, the coating solution is caused to have a high viscosity, so that it is difficult to form a uniform coating in a prescribed amount.

In a preferred embodiment, the copolymer may be dissolved in a suitable solvent (e.g., dichloromethane) to form a carrier coating solution, and the solution may be applied onto a magnetic ferrite carrier by means of an appropriate applicator ("Spira Coater", mfd. by Okada Seiko K.K.). After the application, the coated product may be preliminarily dried at 70°–80° C. to evaporate the solvent, followed by a heat treatment for 0.5–1 hour at 120°–160° C. The coating resin amount of the coated carrier may appropriately be selected so as to satisfy desired durability and charging characteristic, but may generally preferably be in the range of 0.01–30 wt. % of the carrier core. Below 0.01 wt. %, the coating effect is low.

More specifically, the resin coating amount CW (wt. %) may depend on the true specific gravity Z of the carrier core material and may preferably be within the range of $1/2Z \leqq CW \leqq 50/Z$, more preferably in the range of $1/Z \leqq CW \leqq 25/Z$.

The magnetic carrier core material may comprise particles of a magnetic material, such as iron or ferrite.

In order to enhance the adhesion at the boundary between the coating copolymer and the carrier core, it is possible to apply an adhesion promoter, examples of which may include: silane coupling agents, such as methyltrimethoxysilane, methyltriethoxysilane, vinyltriethoxysilane, vinyltris(methoxyethoxysilane), vinyltriacetoxysilane, γ-methacryloxypropyltrimethoxysilane, γ-aminopropyltriethoxysilane, γ-(aminoethyl)aminopropyltriethoxysilane, γ-glycidoxypropyltrimethoxysilane, γ-mercaptopropyltrimethoxysilane, β-(3,4-epoxycyclohexyl)ethyltrimethoxysilane, and γchloropropyltrimethoxysilane; organic titanium compounds, such as tetraisopropyl titanate, tetraisopropyl titanate polymer, tetrabutyl titanate tetrabutyl titanate polymer, tetrastearyl titanate, 2-ethylhexyl titanate, isopropoxytitanium stearate, titanium acetylacetonate and titanium lactate; and organic phosphate-based adhesion promoters. These compounds may be used singly or in mixture of two or more species. These compounds may be applied in advance onto the carrier core, followed by coating with the copolymer of the present invention. Alternatively, it is also possible to admix such an adhesion promoter with the copolymer of the present invention, and then apply the admixture onto the carrier core at a time.

The copolymer used in the present invention may be used in mixture with another resin within an extent of not lowering the effect of the copolymer. Examples of such another resin may include: acrylic resin, styrene-acrylate copolymer resin, ethylene-vinyl acetate copolymer resin, polyester resin, polyethylene resin, polypropylene resin, polyvinylcarbazole resin, phenoxy resin, polycarbonate resin, polyvinyl butyral resin, polystyrene resin, polyvinyl acetate resin, polyallylate resin, and polysulfone resin.

The coated carrier according to the present invention may preferably have a resistivity in the range of $10^8$–$10^{14}$ ohm.cm.

The polycarbonate-polydiorganosiloxane block copolymer can well disperse magnetic material particles and firmly bond with the magnetic material particles. As a result, the copolymer may suitably be used as a binder resin of the magnetic material-dispersion type carrier to solve the problems of the prior art.

In the case of using the polycarbonate-polydiorganosiloxane copolymer as the binder resin of the magnetic material-dispersion type carrier, the copolymer may preferably have a weight-average molecular weight in the range of 10,000 to 50,000. If the molecular weight is below 10,000, the durability is lowered. In excess of 50,000, the melt viscosity of the copolymer at the time of melt-kneading of the copolymer with the particles of the magnetic material is liable to be excessively high, so that a satisfactory melt-kneading is liable to be difficult.

The polycarbonate-polydiorganosiloxane block copolymer may suitably have a glass transition point below 155° C. so as to provide a good processability at the time of melt-kneading. By using the copolymer as a binder resin of the magnetic material-dispersion type carrier, it becomes possible to provide improved wear resistance and anti-toner soiling characteristic and also suppress the toner deterioration. This is presumably because the copolymer of the present invention is rich in lubricity than an ordinary binder resin, thus resulting in an improved anti-toner soiling characteristic and also a reduced shear stress applied to the toner.

Examples of the magnetic material used in the magnetic material-dispersion type carrier may include: ferromagnetic metals, such as iron, cobalt, and nickel, and alloys of these metals, and compounds, such as magnetite and hematite, containing an element showing ferromagnetism, such as iron, cobalt and nickel. The magnetic material may preferably have a saturation magnetization of 10–100 emu/g as measured at a magnetic field of 10 kilo-oersted by means of a tester (e.g., "VSM" available from Toei Kogyo K.K.).

The magnetic material may preferably have an average primary particle size of at most 2.0 μm. If the particle size exceeds 2.0 μm, the resultant carrier particles are liable to have inferior surface state and have a charging ability which is unstable due to a change in environmental condition. The magnetic material fine particles may preferably have a resistivity of at most $10^9$ ohm.cm. The magnetic material may preferably be contained in a proportion of at least 30 wt. %, further preferably at least 50 wt. %, in the carrier composition. Below 30 wt. %, the resultant carrier particles are liable to attach to the photosensitive member and the control of the electrical resistivity of the carrier is liable to be difficult.

Thus, the attachment of the magnetic material-dispersion type carrier according to the present invention onto the photosensitive member can be suppressed, and the ability of charging the carrier can be effectively controlled. In this regard, it is particularly preferred to moderately control the electrical resistivity of the carrier so as not to provide the toner with an excessive charge (i.e., a so-called charge-up phenomenon) under a low humidity condition.

In the present invention, it is possible to prepare carriers with various properties by adjusting the particle size, electrical resistivity and content of the magnetic material fine particles.

The magnetic material-dispersion type carrier may preferably have a true specific gravity of 1.5–5.0, further suitably 1.5–4.5. If the true specific gravity exceeds 5.0, a large load is applied onto the two-component type developer within the developing device, thus being liable to deteriorate the developer. If the true specific gravity is below 1.5, it is difficult to provide a magnetic force sufficient to suppress the attachment of the carrier onto the photosensitive member. The true specific gravity of the carrier may be measured by using, e.g., "Truedenser" (trade mark) available from Seishin Kogyo K.K.

The carrier of the present invention may suitably have an electrical resistivity of $10^7$–$10^{15}$ ohm.cm, preferably $10^8$–$10^{14}$ ohm.cm. If a carrier having a resistivity of below $10^7$ ohm.cm is used in a development method applying a bias voltage, some current is liable to leak from the developing sleeve to the photosensitive member in the developing region, so that it becomes difficult to obtain good toner images. Above $10^{15}$ ohm.cm, the charge-up phenomenon is liable to occur in a low humidity environment to result in image difficulties, such as a low density, transfer failure and fog.

The carrier may preferably have a sphericity (long axis/short axis ratio) of at most 2. If the sphericity exceeds 2, the intended effects are liable to be diminished regarding the effect of reducing the shear stress applied to the developer and the effect of improving the fluidity of the resultant developer.

The sphericity of below 2 may be accomplished by rounding the carrier particles by thermally melting the surfaces thereof or by a mechanical treatment.

The carrier according to the present invention may be produced through various processes including: a process wherein the binder resin and the magnetic material fine particles are blended in an appropriate ratio and melt-kneaded at an appropriate temperature by a hot-melt kneading means such as a three-roll mill or an extruder, followed by cooling, pulverization and classification; and a process wherein the binder resin (copolymer) is dissolved in an appropriate solvent, and the magnetic material is blended therewith to form a slurry, which is then formed into particles and dried by a spray dryer. In any process, it is important to uniformly disperse the magnetic material fine particles within the carrier particles.

The magnetic material-dispersion type carrier prepared through such a process can be further coated with a resin for the purpose of further controlling the resistivity and adjusting the surface property to some extent.

The two-component type developer according to the present invention may be prepared by blending 10–1000 wt. parts, preferably 30–500 wt. parts, of the carrier with 10 wt. parts of a toner.

The toner used in the present invention may suitably have a weight-average particle size of 1–20 μm, preferably 4–13 μm.

The toner used in the present invention, when used in combination with a hot-pressure roller fixing apparatus equipped with an oil applicator, may comprise a binder resin, examples of which may include: polystyrene; polymers of styrene derivatives, such as poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, and styrene-acrylonitrile-indene copolymer; polyvinyl chloride, phenolic resin, natural or modified phenolic resin, natural or modified maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin and petroleum resin.

On the other hand, the toner for use in combination with a hot-pressure roller fixing apparatus using little or no oil, is required to show a sufficient adhesion onto a toner image supporting member as an important characteristic. A toner fixable with less heat energy is generally liable to cause blocking or caking during storage or in the developing device, so that this problem will also require a consideration. Accordingly, for the toner to be used in combination with a hot-pressure roller fixing apparatus with little or no oil application, the selection of the binder resin becomes more important. Preferred binder resins may include crosslinked styrene copolymers and crosslinked polyesters.

Examples of the comonomer to be used in combination with a styrene monomer may include vinyl monomers, including: monocarboxylic acids having a double bond and substitution derivatives thereof, such as acrylic acid, methyl acrylate, ethyl acrylate, butyl acrylate, dodecyl acrylate, octyl acrylate, 2-ethylhexyl acrylate, phenyl acrylate, methyl methacrylate, ethyl methacrylate, butyl methacrylate, octyl methacrylate, acrylonitrile, methacrylonitrile, and acrylamide; dicarboxylic acids having a double bond and substitution derivatives thereof, such as maleic acid, butyl maleate, methyl maleate, and dimethyl maleate; vinyl esters, such as vinyl acetate and vinyl benzoate; polyolefines, such as ethylene, propylene and butylene; vinyl ketones, such as vinyl methyl ketone, and vinyl hexyl ketone; and vinyl ethers, such as vinyl methyl ether and vinyl ethyl ether. These comonomers may be used singly or in combination of two or more species.

The crosslinking agent may principally comprise a compound having at least two polymerizable double bonds. Examples thereof may include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide and divinyl sulfone; and compounds having three or more ethylenic double bonds. These compounds may be used alone or in mixture. At the time of synthesis of a binder resin, the crosslinking agent may preferably be used in a proportion of 0.01–10 wt. %, further preferably 0.05–5 wt. %, based on the binder resin, so as to provide good anti-offset characteristic and fixability.

In the case of using a pressure-fixation system, it is possible to use a binder resin for a pressure-fixable toner, examples of which may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyester, and paraffin.

The toner used in the present invention may preferably be used in combination with a charge control agent which is incorporated in (internally added to) or blended with (externally added to) the toner particles. By the addition of a charge control agent, it becomes possible to effect an optimum charge control depending on a developing system used and provide a further stable balance between the toner particle size distribution and the toner charge. Examples of a positive charge control agent may include: nigrosine and modified products thereof with aliphatic acid metal salts; quaternary ammonium salts, such as tributylbenzylammonium-1-hydroxy-4-naphthosulfonate, and tetrabutylammonium tetrafluoroborate; and organic tin compounds, such as dibutyltin oxide, dioctyltin oxide, dicyclohexyltin oxide, diorganotin oxide, dibutyltin borate, dioctyltin borate, and dicyclohexyltin borate. These compounds may be used singly or in combination of two or more species. Among these, nigrosin-based compounds and quaternary ammonium salts are particularly preferred.

Further, it is also possible to use as a positive charge control agent a homopolymer of a nitrogen-containing monomer represented by the formula:

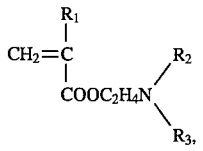

wherein $R_1$ denotes H or $CH_3$, and $R_2$ and $R_3$ respectively denote a substituted or unsubstituted alkyl group having 1–4 carbon atoms; or a copolymer of the nitrogen-containing monomer with another polymerizable monomer as described above, such as styrene, an acrylate or a methacrylate. The resultant nitrogen-containing homopolymer or copolymer can also function as a part or all of the binder resin.

Alternatively, in the present invention, it is also possible to use a negative charge control agent, such as organic metal salts, organic metal complexes, and chelate compounds. Among these, acetylacetone metal complexes (inclusive of monoalkyl-substituted and dialkyl-substituted derivatives), salicylic acid metal complexes (inclusive of monoalkyl-substituted and dialkyl-substituted derivatives), and their corresponding salts are preferred. Salicylic acid-based metal complexes or salicylic acid-based metal salts are particularly preferred. Specific examples of preferred negative charge control agent may include: aluminum acetylacetonate, iron (II) acetylacetonate, 3,5-di-tert-butylsalicylic acid chromium complex or salt, and 3,5-di-tert-butylsalicylic acid zinc complex or salt.

The above-mentioned charge control agents (except for those functioning also as a binder resin) may preferably be used in the form of fine particles having a number-average particle size of at most 4 μm, further preferably at msot 3 μm.

When internally added to the toner, the above charge control agent may preferably be used in a proportion of 0.1–20 wt. parts, particularly 0.2–10 wt. parts, per 100 wt. parts of the binder resin.

The developer according to the present invention may preferably contain silica fine powder. By using a combination of a toner and silica fine powder, the silica fine powder is caused to be present between the toner particles and the carrier particles, thereby remarkably reducing the friction or wearing therebetween. As a result, the toner and the carrier are caused to have a prolonged life and stable chargeability and charging characteristic, so that it is possible to provide a two-component type developer comprising the toner and the carrier showing better performances even in a prolonged period of use.

Particularly, in the case of using a toner having a weight-average particle size of at most 10 μm, the specific surface area per unit weight of the toner is increased than in the case of using a smaller toner, so that the frequency of contact between the carrier and the toner particle surface is increased and the soiling of the carrier is promoted. Even in such a case, a good two-component type developer can be obtained by the addition of silica fine powder.

The silica fine powder may be either dry process silica or wet process silica but may preferably be dry process silica fine powder in view of the anti-filming characteristic and durability.

Herein, the dry process silica means silica fine powder produced, e.g., by vapor-phase oxidation of a silicon halide.

On the other hand, the wet process silica fine powder may be produced through various known processes.

The silica fine powder used herein may include fine powders of: anhydrous silicon dioxide (colloidal silica); and silicates, such as aluminum silicate, sodium silicate, potassium silicate, magnesium silicate and zinc silicate.

A particularly good result may be obtained by using silica fine powder having a specific surface area of at least 30 $m^2/g$, preferably 50–400 $m^2/g$, as measured by the BET method using nitrogen adsorption. It is suitable to use 0.1–8 wt. parts, preferably 0.1–5 wt. parts, of silica fine powder per 100 wt. parts of the toner.

In the case of using the toner as a positively chargeable toner, it is preferred that the silica fine powder added in order to prevent the wearing of the toner and the surface soiling of the carrier is positively chargeable rather than being negatively chargeable, so as not to impair the charging stability. For the same reason, it is preferred to use negatively chargeable silica fine powder for a negatively chargeable toner.

Silica fine powder is generally negatively chargeable. In order to obtain a positively chargeable silica fine powder, the silica fine powder as produced as described above may be treated with a silicone oil having an organic group having a side chain including at least one nitrogen atom, a nitrogen-containing silane coupling agent or both of these.

Examples of the treating agents may include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyltrimethoxysilane, dibutylaminopropyltrimethoxysilane, dibutylaminopropylmonomethoxysilane, dimethylaminophenyltriethoxysilane, trimethoxysilyl-γ-propylphenylamine, and trimethoxysilyl-γ-propylbenzylamine. Further examples may include: trimethoxysilyl-γ-propylpiperidine, trimethoxysilyl-γ-propylmorpholine, trimethoxysilyl-γ-propylimidazole, hexamethyldisilazane, trimethoxysilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The treating agent may suitably be used in an amount of 1–40 wt. % based on the silica fine particles.

In place of the above-mentioned silica fine powder, it is possible to use titanium oxide ($TiO_2$) fine powder having a BET specific surface area of 50–400 $m^2/g$. It is also possible to use a mixture of such silica fine powder and titanium oxide fine powder.

To the toner constituting the developer according to the present invention, it is also possible to add fine powder of a fluorine-containing polymer, such as polytetrafluoroethylene, polyvinylidene fluoride, or tetrafluoroethylenevinylidene fluoride copolymer.

As the colorant for the toner, it is possible to use a dye and/or a pigment known heretofore. Examples thereof may include: carbon black, Phthalocyanine Blue, Peacock Blue, Permanent Red, Lake Red, Rhodamine Lake, Hansa Yellow, Permanent Yellow and Benzidine Yellow. The colorant may be added in an amount of 0.1–20 wt. parts, preferably 0.5–20 wt. parts, per 100 wt. parts of the binder resin. In order to provide a fixed toner image having a good transparency or an OHP film, the colorant may preferably be added in a proportion of at most 12 wt. parts, further preferably 0.5–9 wt. parts, per 100 wt. parts of the binder resin.

The toner constituting the developer according to the present invention can further contain a wax, such as polyethylene, low-molecular weight polypropylene, microcrystalline wax, carnauba wax, sasol wax or paraffin wax in order to improve the releasability at the time of hot pressure fixation. In addition to the above-mentioned additives, it is also possible to add other additives as desired in order to provide the developer according to the present invention.

In preparing the toner constituting the developer according to the present invention, the binder resin of a vinyl-type or non-vinyl-type thermoplastic resin, a pigment or dye as the colorant, an optional charge control agent and other additives may be sufficiently blended in a mixer such as a ball mill and then melt-kneaded by a hot kneading means, such as heated rollers, a kneader or an extruder to compatibly knead the resins and disperse or dissolve therein the pigment or dye. The thus-kneaded product is thereafter cooled for solidification, pulverized and strictly classified to obtain toner particles. The toner particles can be used as a toner as it is but may preferably be mixed with externally added optional silica fine powder or titanium oxide fine powder by means of a blender such as a Henschel mixer to provide a toner. The toner containing an external additive may be blended with the carrier mentioned above to provide a two-component type developer according to the present invention.

Now, methods for measuring various properties of a carrier and a toner will be described.

Average particle size of carrier core and carrier

The average particle sizes of a carrier core and a carrier may be measured by taking at least 300 particles of a sample carrier core or a sample carrier at random through an optical microscope and measuring the average horizontal FERE diameter as an average particle size of the carrier core or the carrier by an image analyzer (e.g., "Luzex 3" available from Nireco K.K.).

Measurement of electrical resistivity of carrier

The resistivity of carrier may be measured by using an apparatus (cell) A as shown in FIG. 1 equipped with a lower electrode 1, an upper electrode 2, an insulator 3, an ammeter 4, a voltmeter 5, a constant-voltage regulator 6 and a guide ring 8. For measurement, the cell A is charged with about 1 g of a sample carrier 7, in contact with which the electrodes 1 and 2 are disposed to apply a voltage therebetween, whereby a current flowing at that time is measured to calculate a resistivity. The above method is applicable not only to a carrier (inclusive of a coated carrier and a magnetic material-dispersion type carrier, but also to a carrier core. In any case, the carrier per may preferably satisfy a resistivity in the range of $10^8$–$10^{14}$ ohm.cm. The resistivity values described herein are based on measurement under the conditions of the contact area between the carrier 7 and the electrode 1 or 2=about 2.3 $cm^2$, the carrier thickness=about 1 mm, the weight of the upper electrode 2=275 g, and the applied voltage=100 volts.

Triboelectric charge of a toner triboelectrically charged with a carrier

Figure 2:
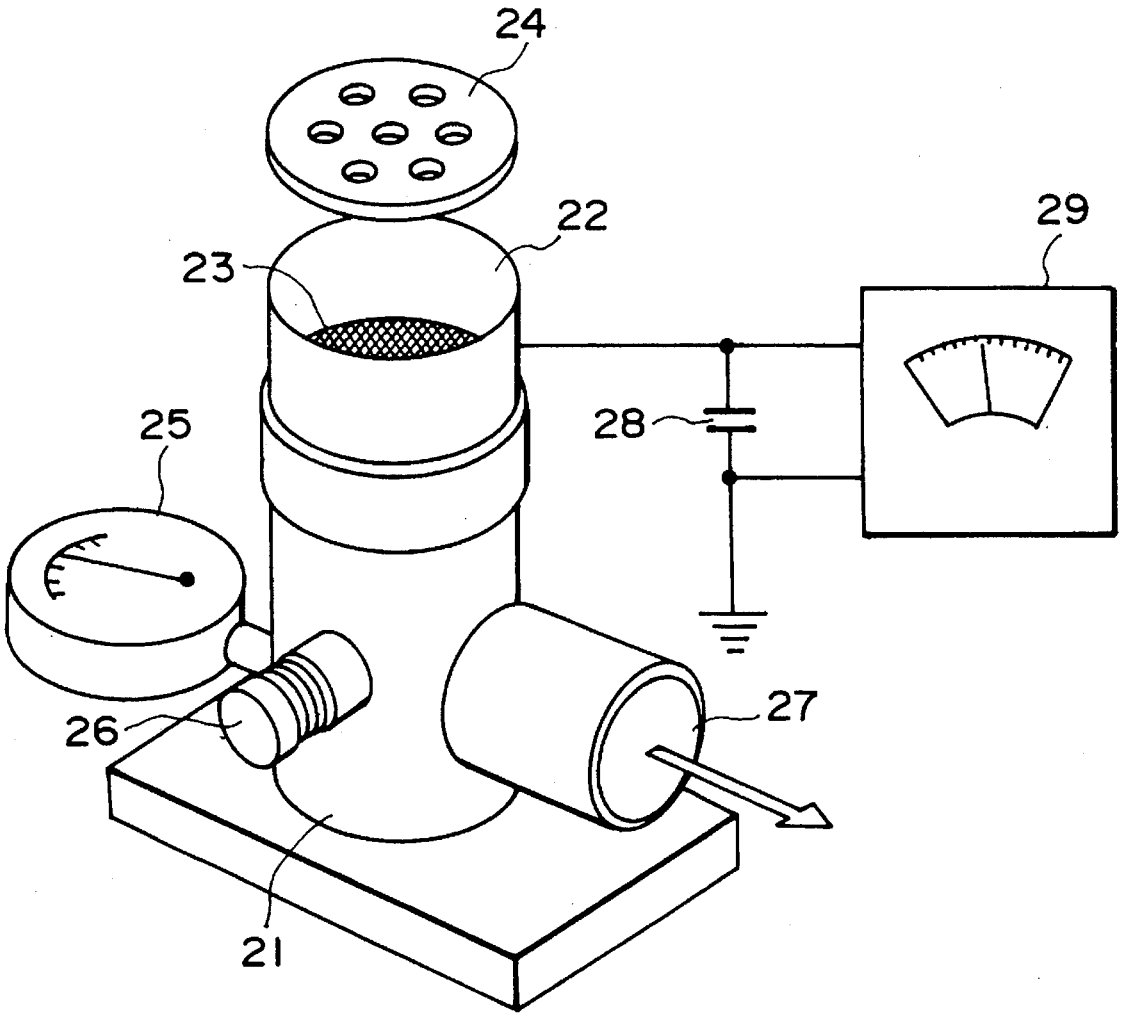
FIG. 2 is a schematic illustration of an apparatus for measuring a triboelectric charge of a toner in a two-component type developer.

The triboelectric charge of a toner may be measured by using an apparatus shown in FIG. 2. A magnetic brush (a mixture of a toner and a magnetic carrier) formed on a developer carrying member is taken and is charged in a metal container 22 for measurement provided with a 500-mesh screen 23 (the screen size being changed to an appropriate size not passing the magnetic powder) at the bottom as shown in FIG. 2 and covered with a metal lid 24. The total weight of the container 22 is weighed and denoted by $W_1$ (g). Then, an aspirator 21 composed of an insulating material at least with respect to a part contacting the container 22 is operated, and the toner in the container is removed by suction through a suction port 27 sufficiently (for about 1 min.) while controlling the pressure at a vacuum gauge 25 at 250 mmHg by adjusting an aspiration control valve 26. The reading at this time of a potential meter 29 connected to the container by the medium of a capacitor 28 having a capacitance C (μF) is denoted by V (volts.). The total weight of the container after the aspiration is measured and denoted by $W_2$ (g). Then, the triboelectric charge Q (μC/g) is calculated as:

$$Q\ (\mu C/g)=C\times V/(W_1-W_2).$$

The measurement may suitably be performed in an environment of a temperature of 23° C. and a humidity of 65% RH.

True specific gravity of carrier core and carrier

The specific gravity of a carrier core or a carrier may be measured by "Truedenser" (available from Seishin Kogyo K.K.).

Weight-average particle size of toner

The weight-average particle size of a toner may be measured by a Coulter counter (e.g., "Model TA-II", available from Coulter Electronics Inc.), to which an interface (available from Nikkaki K.K.) for providing a number-basis distribution and a volume-basis distribution, and a personal computer CX-1 (available from Canon K.K.) are connected.

For measurement, a 1%-NaCl aqueous solution as an electrolyte solution is prepared by using a reagent-grade sodium chloride. Into 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a number-basis distribution, from which a weight-average particle size is calculated.

Hereinbelow, the present invention will be described based on Examples, which however should not be construed to restrict the scope of the invention. In the following description, "%" and "part(s)" are all by weight, and Mw and Mn denote a weight average molecular weight and a number-average molecular weight, respectively.

EXAMPLE 1

A spherical magnetic ferrite carrier core was coated with a coating resin, which was a polycarbonate-polysiloxane block copolymer (Mw=25,000) comprising 90 wt. % of a polycarbonate block represented by the following formula (33):

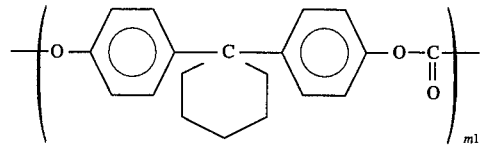

(33)

(ml: an integer), and 10 wt. % of a polydialkylsiloxane block represented by the following formula (34):

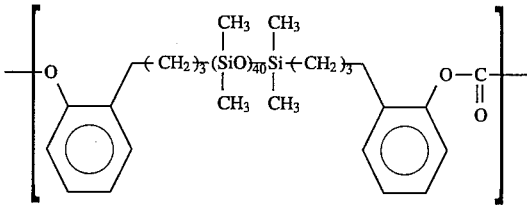

(34)

More specifically, 15 parts of the block copolymer was dissolved in 85 parts of tetrahydrofuran to form a carrier coating solution. The solution was applied onto spherical magnetic ferrite core particles having an average particle size of 45 μm by using a coater ("Spira Coater" available from Okada Seiko K.K.), followed by preliminary drying at 80° C. for 20 min. and drying at 150° C. for 40 min. to prepare a resincoated carrier having an average particle size of ca. 45 μm. The coated carrier showed a resistivity of $10^{11}$ ohm.cm and a specific gravity of ca. 5. The coated carrier after the coating step showed a resin coating rate of 0.94% and showed a good coating state as a result of observation through an electron microscope.

Separately, a toner was prepared as follows.

| | |
|---|---|
| Polyester resin obtained through condensation of propoxidized bisphenol and fumaric acid | 100 parts |
| Phthalocyanine pigment | 5 parts |
| Chromium complex salt of di-tert-butylsalicylic acid | 4 parts |

The above ingredients were preliminarily blended sufficiently by a Henschel mixer and then melt-kneaded three times through a three-roll mill. After cooling, the kneaded product was coarsely crushed into particles of ca. 1–2 mm and finely pulverized by an air jet pulverizer, followed by classification to obtain a negatively chargeable nonmagnetic cyan toner having a weight-average particle size of 8.3 μm.

100 parts of the cyan toner and 0.4 part of negatively chargeable hydrophobic silica fine powder ($S_{BET}$ (BET specific surface area)=200 $m^2/g$) treated with hexamethyldisilazane were blended by a Henschel mixer to prepare a toner carrying silica fine powder on the surface.

15 parts of the cyan toner and 85 parts of the coated carrier were blended in an N/N (normal temperature/normal humidity=23° C./60% RH) environment to obtain a two-component type developer. Then, 100 g of the thus-obtained developer was placed in a 250 cc-plastic bottle and subjected to shaking for 1 hour by a Tabulla Mixer (trade mark) in the same normal temperature/normal humidity environment. Thereafter, the developer was taken out and subjected to observation through an electron microscope. As a result, no peeling of the coating layer from the carrier or filming of the toner was observed.

Further, the developer was charged in a full color laser copying machine (a remodeling of a commercially available machine "CLC-500" available from Canon K.K.) to effect an image formation test. As a measurement at an interruption of the image forming test, the toner in the two-component type developer on the developing sleeve showed a triboelectric charge of −20 μc/g.

As a result of the image forming test, it was possible to obtain clear images having a sufficiently high image density at a solid image part and free from fog at a non-image part or roughing of image at a halftone part. The developing device was taken out of the re-modelled copying machine and the developing sleeve thereof was subjected to a blank rotation at 200 rpm for 40 minutes without forming images by using an external drive motor. The developing device was recharged in the remodelled copying machine, and the image formation test was resumed, whereby good toner images were formed without causing rough images at the halftone part.

The results are summarized in Table 1 appearing hereinafter.

EXAMPLE 2

A spherical magnetic ferrite carrier core was coated with a coating resin, which was a polycarbonate-polysiloxane block copolymer (Mw=15,000) comprising 70 wt. % of a polycarbonate block represented by the following formula (35):

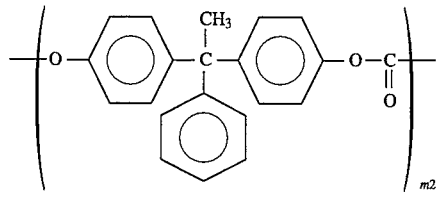

(35)

(m2: an integer), and 30 wt. % of a polydialkylsiloxane block represented by the above mentioned formula (34).

More specifically, 15 parts of the block copolymer was dissolved in 85 parts of dioxane to form a carrier coating solution. The solution was applied onto spherical magnetic ferrite core particles having an average particle size of 45 μm preliminarily treated with methyltrimethoxysilane by using a coater ("Spira Coater" available from Okada Seiko K.K.), followed by preliminary drying at 80° C. for 20 min. and drying at 150° C. for 40 min. to prepare a resincoated carrier having an average particle size of ca. 45 μm. The coated carrier after the coating step showed a resin coating rate of 0.95% and showed a good coating state as a result of observation through an electron microscope.

The performances of the carrier thus obtained were evaluated in the same manner as in Example 1, whereby good results were obtained as summarized in Table 1 appearing hereinafter.

EXAMPLE 3

A spherical magnetic ferrite carrier core was coated with a coating resin, which was a polycarbonate-polysiloxane block copolymer (Mw=45,000) comprising 50 wt. % of a polycarbonate block represented by the following formula (36):

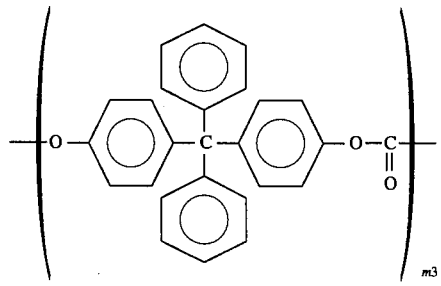

(36)

(m3: an integer), and 50 wt. % of a polydialkylsiloxane block represented by the following formula (37):

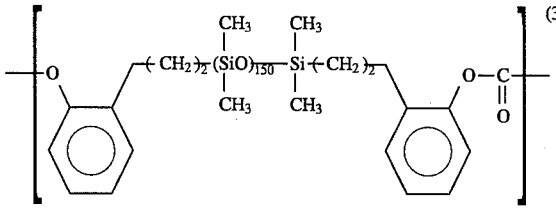

(37)

More specifically, 15 parts of the block copolymer and 1 part of tetraisopropyl titanate were dissolved in 85 parts of tetrahydrofuran to form a carrier coating solution. The solution was applied onto spherical magnetic ferrite core particles having an average particle size of 50 μm by using a coater ("Spira Coater" available from Okada Seiko K.K.), followed by preliminary drying at 80° C. for 20 min. and drying at 150° C. for 40 min. to prepare a resincoated carrier having an average particle size of ca. 50 μm. The coated carrier after the coating step showed a resin coating rate of 0.94% and showed a good coating state as a result of observation through an electron microscope.

The performances of the carrier thus obtained were evaluated in the same manner as in Example 1, whereby good results were obtained as summarized in Table 1.

EXAMPLE 4

A spherical magnetic ferrite carrier core was coated with a coating resin, which was a polycarbonate-polysiloxane block copolymer (Mw=30,000) comprising 90 wt. % of a polycarbonate block represented by the following formula (38):

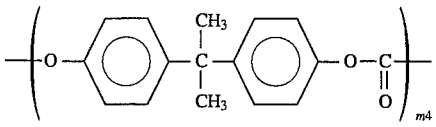

(38)

(m4: an integer), and 10 wt. % of a polydialkylsiloxane block represented by the above-mentioned formula (34).

More specifically, 15 parts of the block copolymer was dissolved in 85 parts of dioxane to form a carrier coating solution. The solution was applied onto spherical magnetic ferrite core particles having an average particle size of 50 μm by using a coater ("Spira Coater" available from Okada Seiko K.K.), followed by preliminary drying at 80° C. for 20 min. and drying at 150° C. for 40 min. to prepare a resincoated carrier having an average particle size of ca. 50 μm. The coated carrier after the coating step showed a resin coating rate of 0.90% and showed a good coating state as a result of observation through an electron microscope.

The performances of the carrier thus obtained were evaluated in the same manner as in Example 1, whereby good results were obtained as summarized in Table 1.

EXAMPLE 5

A spherical magnetic ferrite carrier core was coated with a coating resin, which was a polycarbonate-polysiloxane block copolymer (Mw=25,000) comprising 90 wt. % of a polycarbonate block 20 represented by the following formula (39):

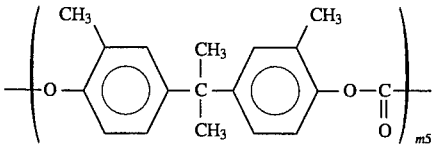

(39)

(m5: an integer), and 10 wt. % of a polydialkylsiloxane block represented by the above-mentioned formula (34).

More specifically, 15 parts of the block copolymer and 1 part of methyltriethoxysilane were dissolved in 85 parts of dioxane to form a carrier coating solution. The solution was applied onto spherical magnetic ferrite core particles having an average particle size of 50 μm by using a coater ("Spira Coater" available from Okada Seiko K.K.), followed by preliminary drying at 80° C. for 20 min. and drying at 150° C. for 40 min. to prepare a resincoated carrier having an average particle size of ca. 50 μm. The coated carrier after the coating step showed a resin coating rate of 0.90 % and showed a good coating state as a result of observation through an electron microscope.

The performances of the carrier thus obtained were evaluated in the same manner as in Example 1, whereby good results were obtained as summarized in Table 1.

EXAMPLE 6

A spherical magnetic ferrite carrier core was coated with a coating resin, which was a polycarbonate-polysiloxane block copolymer (Mw=8,000) comprising 90 wt. % of a polycarbonate block represented by the following formula (40):

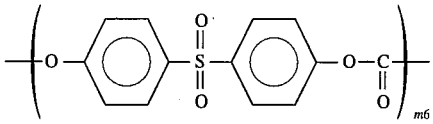

(40)

(m6: an integer), and 10 wt. % of a polydialkylsiloxane block represented by the above-mentioned formula (34).

More specifically, 15 parts of the block copolymer was dissolved in 85 parts of tetrahydrofuran to form a carrier coating solution. The solution was applied onto spherical magnetic ferrite core particles having an average particle size of 50 μm by using a coater ("Spira Coater" available from Okada Seiko K.K.), followed by preliminary drying at 80° C. for 20 min. and drying at 150° C. for 40 min. to prepare a resincoated carrier having an average particle size of ca. 50 μm. The coated carrier after the coating step showed a resin coating rate of 0.90% and showed a good coating state as a result of observation through an electron microscope.

The performances of the carrier thus obtained were evaluated in the same manner as in Example 1, whereby good results were obtained as summarized in Table 1.

EXAMPLE 7

A spherical magnetic ferrite carrier core was coated with a coating resin, which was a polycarbonate-polysiloxane block copolymer (Mw=95,000) comprising 90 wt. % of a polycarbonate block represented by the following formula (41):

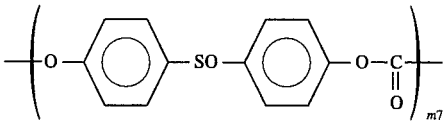

(41)

(m7: an integer), and 10 wt. % of a polydialkylsiloxane block represented by the above-mentioned formula (34).

More specifically, 15 parts of the block copolymer was dissolved in 95 parts of chlorobenzene to form a carrier coating solution. The solution was applied onto spherical magnetic ferrite core particles having an average particle size of 50 μm by using a coater ("Spira Coater" available from Okada Seiko K.K.), followed by preliminary drying at 80° C. for 20 min. and drying at 150° C. for 40 min. to prepare a resin-coated carrier having an average particle size of ca. 50 μm. The coated carrier after the coating step showed a resin coating rate of 0.90 % and showed a good coating state as a result of observation through an electron microscope.

The performances of the carrier thus obtained were evaluated in the same manner as in Example 1, whereby good results were obtained as summarized in Table 1.

Comparative Example 1

A resin-coated carrier was prepared in a similar manner as in Example 1 except for the use of styrene/2-ethylhexyl methacrylate copolymer (copolymerization ratio=40/60); Mw (corr. to the weight-average molecular weight of standard polystyrene according to gel permeation chromatography)=30,000) as the coating resin. As a result of the evaluation of the coated carrier in the same manner as in Example 1, a filming of spent toner on the carrier particle surface was clearly recognized as a result of observation of the carrier after the shaking through an electron microscope. After the successive copying test in the same manner as in Example 1, there resulted in unclear toner images accompanied with fog at non-image part and roughening of halftone images. The results are also summarized in Table 1.

Comparative Example 2

A resin-coated carrier was prepared in a similar manner as in Example 1 except for the use of bisphenol A polycarbonate (Mw=25,000) as the coating resin. As a result of the evaluation of the coated carrier in the same manner as in Example 1, a filming of spent toner on the carrier particle surface was clearly recognized as a result of observation of the carrier after the shaking through an electron microscope. After the successive copying test in the same manner as in Example 1, there resulted in unclear toner images accompanied with fog at non-image part and roughening of halftone images. The results are also summarized in Table 1.

Comparative Example 3

A resin-coated carrier was prepared except for the use of a silicone resin ("KR 9706" available from Shin-Etsu Kagaku Kogyo K.K.) as the coating resin. The results of evaluation thereof are also summarized in Table 1.

TABLE 1

| | Shaking test | | Successive copying test | | |
|---|---|---|---|---|---|
| Examples | Peeling | Filming | Solid image density | Roughening of halftone image | Roughening of halftone image |
| Ex. | | | | | |
| 1 | 4 | 4 | 4 | 4 | 4 |
| 2 | 4 | 4 | 4 | 4 | 4 |
| 3 | 4 | 4 | 3 | 4 | 4 |
| 4 | 4 | 4 | 4 | 4 | 4 |
| 5 | 4 | 4 | 4 | 4 | 4 |
| 6 | 3 | 2 | 4 | 3 | 2 |
| 7 | 3 | 2 | 3 | 3 | 2 |
| Comp. Ex. | | | | | |
| 1 | 2 | 2 | 3 | 3 | 1 |
| 2 | 2 | 2 | 3 | 3 | 2–1 |
| 3 | 1 | 1 | 3 | 2 | 1 |

The evaluation standards in Table 1 are as follows.

Peeling

The peeling state of the coating of the coated carrier was evaluated with reference to that in Comparative Example 1 as a result of observation through an electron microscope.

4: Excellent. Extremely less peeling than in Comparative Example 1.

3: Good. Less peeling than in Comparative Example 1.

2: Fair. Identical level of peeling as in Comparative Example 1.

1: Not acceptable. More peeling than in Comparative Example 1.

Filming

The filming state on the coated carrier was evaluated with reference to that in Comparative Example 1 as a result of observation through an electron microscope.

4: Excellent. Extremely less filming than in Comparative Example 1.

3: Good. Less filming than in Comparative Example 1.

2: Fair. Identical level of filming as in Comparative Example 1.

1: Not acceptable. More filming than in

Comparative Example 1.

Solid image density

4: Excellent. A clearly higher image density than in Comparative Example 1.

3: Good. An identical level of image density as in Comparative Example 1.

Roughening of halftone images

The roughening of a halftone images was evaluated by eyes with reference to Comparative Example 1.

4: Excellent. Very smooth halftone images with extremely less roughening than in Comparative Example 1.

3: Good. Smooth halftone images with less roughening than in Comparative Example 1.

2: Fair. Halftone images with less roughening than in Comparative Example 1.

1: Not acceptable. Halftone images with roughening identical to that in Comparative Example 1.

EXAMPLE 8

A magnetic material-dispersion type carrier was prepared by using a binder resin, which was a polycarbonate-polysiloxane block copolymer (Mw=20,000; Tg (glass transition temperature)=136° C.) comprising 90 wt. % of a polycarbonate block of the above-mentioned formula (38) and 10 wt. % of a polydialkylsiloxane block of the above-mentioned formula (34). More specifically, 20 parts of the block copolymer and 90 parts of ferrite fine powder (Dav. (average particle size)=0.33 μm; Rsp (electrical resistivity)=$10^7$ ohm.cm, $\sigma_{sat}$ (saturation magnetization)=85 emu/g) were preliminarily blended sufficiently by a Henschel mixer and melt-kneaded three times by a three-roll mill. After cooling, the kneaded product was coarsely crushed into particles of ca. 1–2 mm by a hammer mill and then finely pulverized by an air jet pulverizer to obtain a magnetic material-dispersion type carrier. The physical properties of the carrier are shown in Table 2 appearing hereinafter.

Separately, a negatively chargeable cyan toner having a weight-average particle size of 8.4 μm was prepared in the same manner as in Example 1.

100 parts of the cyan toner and 0.4 part of negatively chargeable hydrophobic silica fine powder treated with hexamethyldisilazane were blended by a Henschel mixer to prepare a toner carrying silica fine powder on the surface.

The cyan toner and the above-prepared carrier were blended in an N/N (normal temperature/normal humidity=23° C./60% RH) environment to obtain a two-component type developer having a toner concentration of 10%. Then, 100 g of the thus-obtained developer was placed in a 250 cc-plastic bottle and subjected to shaking for 1 hour by a Tabullar Mixer. Thereafter, the developer was taken out and subjected to observation through an electron microscope. As a result, no filming of the toner was observed. No separation of the externally added silica fine powder from the toner or embedding of the silica fine powder in the toner was observed either.

Further, 8 parts of the above-prepared cyan toner and 98 parts of the magnetic material-dispersion type carrier were blended in a L/L (low temperature/low humidity=15° C./10% RH) environment to obtain a two-component type developer.

The developer was charged in a full color laser copying machine (a remodeling of a commercially available machine "CLC-500" available from Canon K.K.). Before image formation, the developing device was taken out of the remodelled copying machines, and the developing sleeve thereof was subjected to a blank rotation at 200 rpm for 40 min. without forming images by using an external drive motor. Then, the developing device was re-set in the remodelled copying machine and used for an image formation test. As a measurement at an interruption of the image forming test, the toner in the two-component type developer on the developing sleeve showed a triboelectric charge of −20 μc/g.

As a result of the image forming test, it was possible to obtain clear images having a sufficiently high image density at a solid image part and free from fog at a non-image part or roughing of image at a halftone part. As a result of image formation after the blank rotation of the developing sleeve in the developing device, good toner images were formed without causing rough images at the halftone part. Substantially no carrier attachment to the photosensitive member was observed either before or after the blank rotation.

The results are summarized in Table 3 appearing hereinafter.

EXAMPLE 9

A magnetic material-dispersion type carrier was prepared by using a binder resin, which was a polycarbonate-polysiloxane block copolymer comprising 80 wt. % of a polycarbonate block of the above-mentioned formula (33) and 20 wt. % of the polydialkylsiloxane block of the following formula (42):

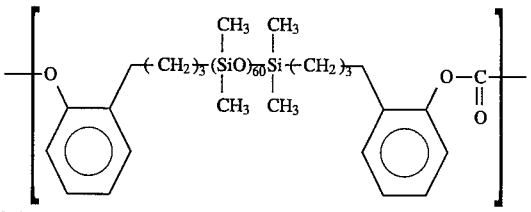

(42)

More specifically, 20 parts of the block copolymer and 80 parts of reduced iron fine powder (Dav.=0.32 μm, Rsp=6=$10^3$ ohm.cm, $\sigma_{sat}$=139 *emu/g*) were preliminarily blended sufficiently by a Henschel mixer and melt-kneaded three times by a three-roll mill. After cooling, the kneaded product was coarsely crushed to a particle size of ca. 2 mm and then finely pulverized to a particle size of 50 μm by an air jet pulverizer. The finely pulverized product was then mechanically made spherical by "Mechano Mill MM10" (available from Okada Seiko K.K.). The spherical finely pulverized product was classified to obtain carrier particles having an average particle size of 48 μm.

The physical properties of the carrier are shown in Table 2.

The carrier was evaluated in the same manner as in Example 8, whereby good results were obtained in the shaking test and in the image forming test. The results are shown in Table 3.

EXAMPLE 10

A magnetic material-dispersion type carrier was prepared by using a binder resin, which was a polycarbonate-polysiloxane block copolymer comprising 70 wt. % of a polycarbonate block of the above-mentioned formula (39) and 30 wt. % of the polydialkylsiloxane block of the above-mentioned formula (34). More specifically, 22 parts of the block copolymer and 78 parts of magnetite fine powder (Dav.=0.26 μm, Rsp=$10^5$ ohm.cm, $\sigma_{sat}$=83 emu/g) were preliminarily blended sufficiently by a Henschel mixer and melt-kneaded three times by a three-roll mill. After cooling, the kneaded product was coarsely crushed to a particle size of ca. 2 mm and then finely pulverized to a particle size of 50 μm by an air jet pulverizer. The finely pulverized product was then mechanically made spherical by "Mechano Mill MM-10" (available from Okada Seiko K.K.). The spherical finely pulverized product was classified to obtain carrier particles having an average particle size of 54 μm.

The physical properties of the carrier are shown in Table 2.

The carrier was evaluated in the same manner as in Example 8, whereby good results were obtained in the shaking test and in the image forming test. The results are shown in Table 3.

EXAMPLE 11

A magnetic material-dispersion type carrier was prepared by using a binder resin, which was a polycarbonate-polysiloxane block copolymer comprising 70 wt. % of a polycarbonate block of the above-mentioned formula (35) and 30 wt. % of the polydialkylsiloxane block of the following formula (43):

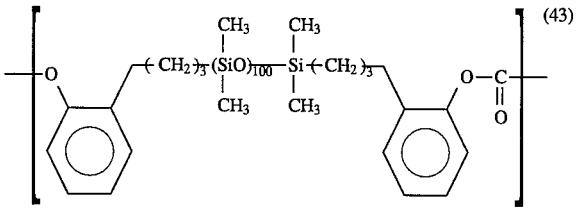

(43)

More specifically, 20 parts of the block copolymer and 80 parts of magnetic ferrite fine powder (Dav.=0.26 μm, Rsp=$10^7$ ohm.cm, $\sigma_{sat}$=85 emu/g) were preliminarily blended sufficiently by a Henschel mixer and melt-kneaded three times by a three-roll mill. After cooling, the kneaded product was coarsely crushed to a particle size of ca. 2 mm and then finely pulverized to a particle size of 50 μm by an air jet pulverizer. The finely pulverized product was then mechanically made spherical by "Mechano Mill MM-10" (available from Okada Seiko K.K.). The spherical finely pulverized product was classified to obtain carrier particles having an average particle size of 48 μm.

The physical properties of the carrier are shown in Table 2.

The carrier was evaluated in the same manner as in Example 8, whereby good results were obtained in the shaking test and in the image forming test. The results are shown in Table 3.

EXAMPLE 12

A magnetic material-dispersion type carrier was prepared by using a binder resin, which was a polycarbonate-polysiloxane block copolymer comprising 50 wt. % of a polycarbonate block of the above-mentioned formula (36) and 20 wt. % of the polydialkylsiloxane block of the above-mentioned formula (37). More specifically, 20 parts of the block copolymer and 80 parts of reduced iron fine powder (Dav.=0.32 μm, Rsp=6×$10^3$ ohm.cm, $\sigma_{sat}$=139 emu/g) were preliminarily blended sufficiently by a Henschel mixer and melt-kneaded three times by a three-roll mill. After cooling, the kneaded product was coarsely crushed to a particle size of ca. 2 mm and then finely pulverized to a particle size of 50 μm by an air jet pulverizer. The finely pulverized product was then mechanically made spherical by "Mechano Mill MM-10" (available from Okada Seiko K.K.). The spherical finely pulverized product was classified to obtain carrier particles having an average particle size of 51 μm.

The physical properties of the carrier are shown in Table 2.

The carrier was evaluated in the same manner as in Example 8, whereby good results were obtained in the shaking test and in the image forming test. The results are shown in Table 3.

Comparative Example 4

Carrier core particles of reduced iron having an average particle size of 43 μm (Rsp=$6\times10^3$ ohm/cm, $\sigma_{sat}$=139 emu/g) was coated with styrene/2-ethylhexyl methacrylate copolymer (copolymerization weight ratio=50/50); Mw=39,000, Mw/Mn=2.7) dissolved in toluene to form a resin-coated carrier having a resin coating rate of 0.8% in a similar manner as in Example 1.

The physical properties of the resin-coated carrier are shown in Table 2.

The carrier was evaluated in the same manner as in Example 8.

As a result of the shaking test, the carrier showed no change but some degree of embedding of the externally added silica into the toner particle surfaces was observed. As a result of the image formation test, the roughening of the halftone images was observed. The results are shown In Table 3.

TABLE 2

| Examples | Properties of carrier: True specific gravity [–] | Particle size Dav. [μm] | Resistivity Rsp [Ω · cm] |
|---|---|---|---|
| Ex. | | | |
| 8 | 3.2 | 47 | $2\times10^{11}$ |
| 9 | 3.8 | 48 | $3\times10^{10}$ |
| 10 | 3.1 | 54 | $5\times10^{8}$ |
| 11 | 3.3 | 48 | $3\times10^{10}$ |
| 12 | 3.8 | 51 | $2\times10^{11}$ |
| Comp. Ex. | | | |
| 4 | 7.8 | 43 | $1\times10^{11}$ |

TABLE 3

| Examples | Toner*1: filming on carrer | Image formation test after blank rotation in an L/L environment: Carrier attachment | Halftone images *2 |
|---|---|---|---|
| Ex. | | | |
| 8 | none | none | 4 |
| 9 | " | " | 4 |
| 10 | " | " | 3 |
| 11 | " | " | 3 |
| 12 | " | " | 3 |
| Comp. Ex. | | | |
| 4 | observed | " | 1 |

*1: As a result of observation through a SEM of the carrier surface after the shaking in a plastic bottle.
*2: The evaluation of halftone images was performed by observation with eyes with reference to the halftone images in Comparative Example 4.
4: Excellent. Very smooth halftone images with extremely less roughening than in Comparative Example 4.
3: Good. Smooth halftone images with less roughening than in Comparative Example 4.
2: Fair. Halftone images with less roughening than in Comparative Example 4.
1: Not acceptable. Halftone images with roughening identical to that in Comparative Example 4.

What is claimed is:

1. A carrier for use in electrophotography, comprising: carrier particles which comprise a magnetic material and a resin, said resin comprising a copolymer having structural units of the following formulae [1] and [2]:

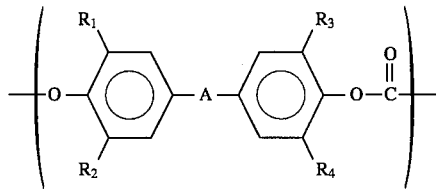

[1]

wherein A denotes a $C_1$–$C_{10}$ linear, branched or cyclic alkylidene group, aryl-substituted alkylidene group or arylenedialkylidene group, —O—, —S—, —CO—, —SO— or —$SO_2$—; and $R_1$–$R_4$ independently denote hydrogen, halogen, or a $C_1$–$C_4$ alkyl or alkenyl group;

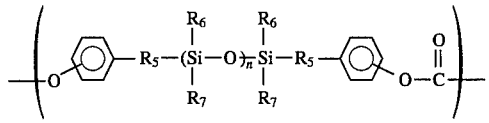

[2]

wherein $R_5$ denotes a $C_2$–$C_6$ alkylene or alkylidene group; $R_6$ and $R_7$ denote a $C_1$–$C_3$ alkyl group, a phenyl group or a substituted phenyl group; and n is a integer of 1–200, wherein said carrier particles have an average particle size of 5–100 μm.

2. The carrier according to claim 1, wherein said copolymer contains 0.1–50 mol. % of the structural unit of the formula [2].

3. The carrier according to claim 1, wherein said copolymer is a resin formed from compounds of the following formulae [1A] and [2A] and phosgene:

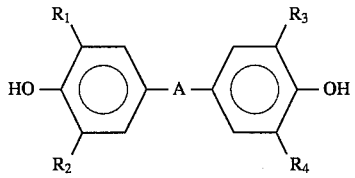

[1A]

wherein $R_1$–$R_4$ and A are respectively the same as in the formula [1], and

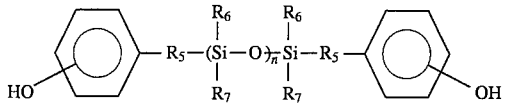

[2A]

wherein $R_5$–$R_7$ and n are respectively the same as in the formula [2].

4. The carrier according to claim 1, wherein the structural unit of the formula [2] is reduced to the following formula [2B]:

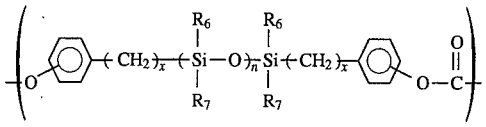

[2B]

wherein $R_6$ and $R_7$ are respectively the same as in the formula [2], and x is an integer of 2–6.

5. The carrier according to claim 3, wherein the compound of the formula [2] is a polyorganosiloxane selected from the group consisting of those represented by the following formulae:

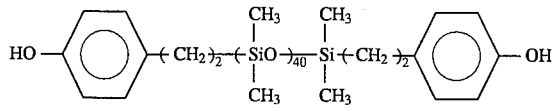

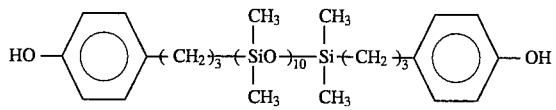

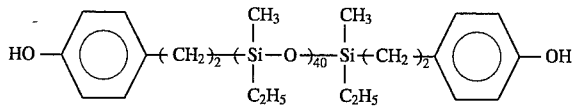

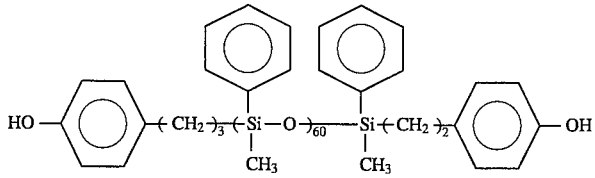

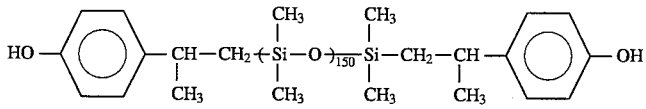

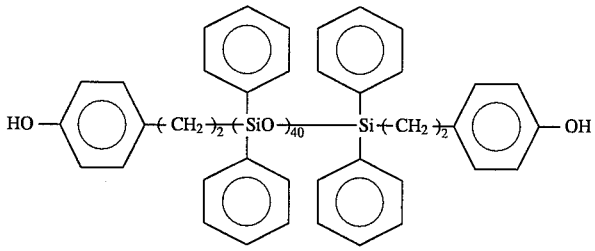

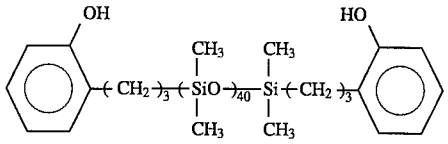

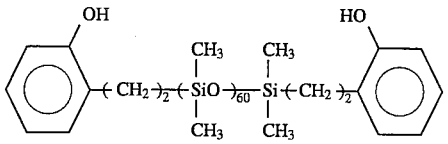

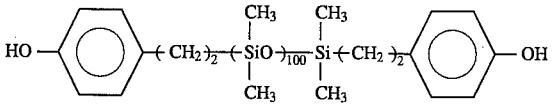

-continued

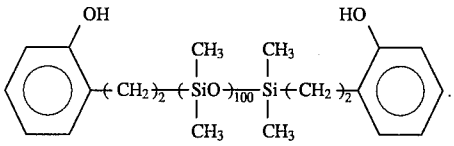

6. The carrier according to claim 1, wherein the copolymer comprises a block copolymer unit of the following formula [3]:

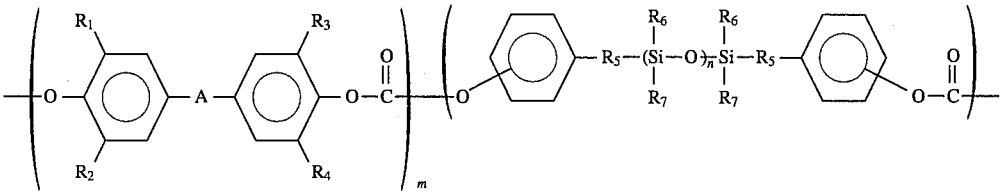

[3]

wherein $R_1$–$R_4$ and A are respectively the same as in the formula [1], $R_5$–$R_7$ and n are respectively the same as in the formula [2], and m is a positive integer.

7. The carrier according to claim 1, wherein the magnetic material constitutes a carrier core.

8. The carrier according to claim 7, wherein the carrier core of the magnetic material is coated with the copolymer having the structural units of the formulae [1] and [2].

9. The carrier according to claim 7, wherein the carrier core has an average particle size of 5–100 μm.

10. The carrier according to claim 9, wherein the carrier core comprises iron or iron oxide.

11. The carrier according to claim 9, wherein the carrier core comprises ferrite.

12. The carrier according to claim 7, wherein the carrier core is coated with the resin in an coating amount CW (wt. %) in the range of $1/2Z \leqq CW \leqq 50/Z$ with respect to a true specific gravity Z of the carrier core.

13. The carrier according to claim 12, wherein the carrier core is coated with the resin in an coating amount CW (wt. %) in the range of $1/Z \leqq CW \leqq 25/Z$ with respect to a true specific gravity Z of the carrier core.

14. The carrier according to claim 7, wherein the carrier core is coated with 0.01–30 wt. % of the resin.

15. The carrier according to claim 1, wherein the copolymer has a weight-average molecular weight of $1\times10^4$–$10\times10^4$.

16. The carrier according to claim 1, having an electrical resistivity of $10^8$–$10^{14}$ ohm.cm.

17. The carrier according to claim 1, comprising magnetic material-dispersion type carrier particles each comprising the magnetic material dispersed within the resin.

18. The carrier according to claim 17, wherein the magnetic material has a primary average particle size of at most 2.0 μm.

19. The carrier according to claim 18, having an average particle size of 5–100 μm.

20. The carrier according to claim 18, wherein the magnetic material has an electrical resistivity of at most $10^9$ ohm.cm.

21. The carrier according to claim 17, wherein the magnetic material is contained in a proportion of at most 30 wt. %.

22. The carrier according to claim 1, wherein the structural unit of the formula [1] is represented by the following formula:

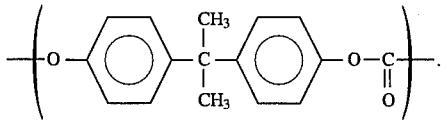

23. The carrier according to claim 1, wherein the structural unit of the formula [1] is represented by the following formula:

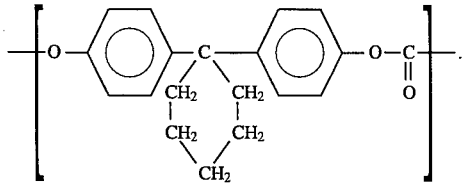

24. The carrier according to claim 1, wherein the structural unit of the formula [1] is represented by the following formula:

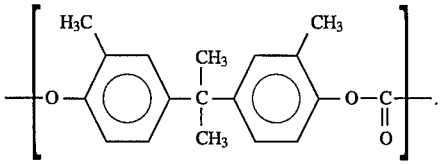

25. The carrier according to claim 1, wherein the structural unit of the formula [1] is represented by the following formula:

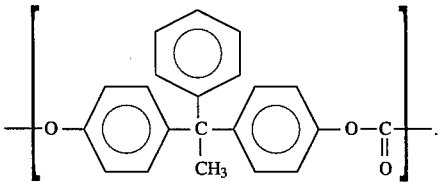

26. The carrier according to claim 1, wherein the structural unit of the formula [1] is represented by the following formula:

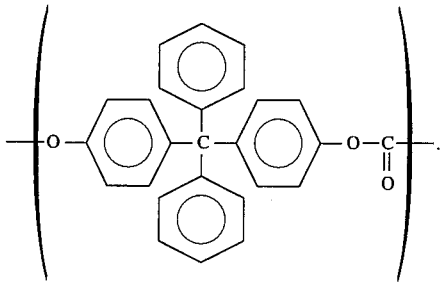

27. A two-component type developer for developing an electrostatic image, comprising a toner and a carrier, said carrier comprising: carrier particles which comprise a magnetic material and a resin, said resin comprising a copolymer having structural units of the following formulae ([1] and [2]:

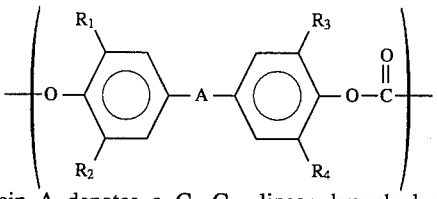

[1]

wherein A denotes a $C_1$–$C_{10}$ linear, branched or cyclic alkylidene group, aryl-substituted alkylidene group or arylenedialkylidene group, —O—, —S—, —CO—, —SO— or —$SO_2$—; and $R_1$–$R_4$ independently denote hydrogen, halogen, or a $C_1$–$C_4$ alkyl or alkenyl group;

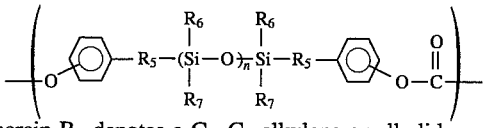

[2]

wherein $R_5$ denotes a $C_2$–$C_6$ alkylene or alkylidene group; $R_6$ and $R_7$ denote a $C_1$–$C_3$ alkyl group, a phenyl group or a substituted phenyl group; and n is a integer of 1–200, wherein said carrier particles have an average particle size of 5–100 μm.

28. The developer according to claim 27, wherein said copolymer contains 0.1–50 mol. % of the structural unit of the formula [2].

29. The developer according to claim 27, wherein said copolymer is a resin formed from compounds of the following formulae [1A] and [2] and phosgene:

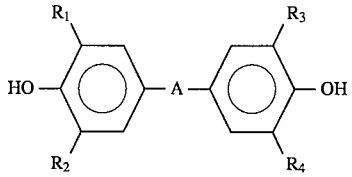

[1A]

wherein $R_1$–$R_4$ and A are respectively the same as in the formula [1], and

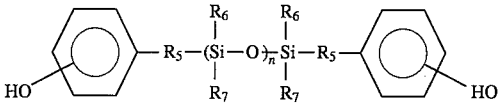

[2A]

wherein $R_5$–$R_7$ and n are respectively the same as the formula [2].

30. The developer according to claim 27, wherein the structural unit of the formula [2] is reduced to the following formula [2B]:

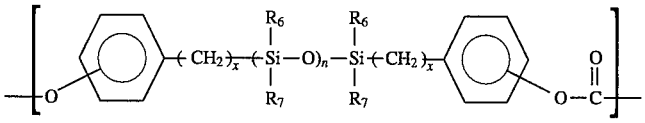

[2B]

wherein $R_6$ and $R_7$ are respectively the same as in the formula [2], and x is an integer of 2–6.

31. The developer according to claim 30, wherein the compound of the formula [2] is a polyorganosiloxane selected from the group consisting of those represented by the following formulae:

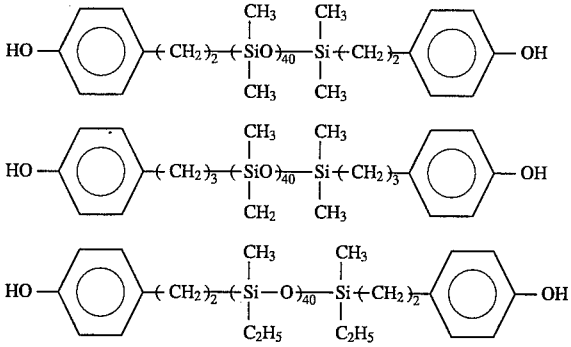

-continued

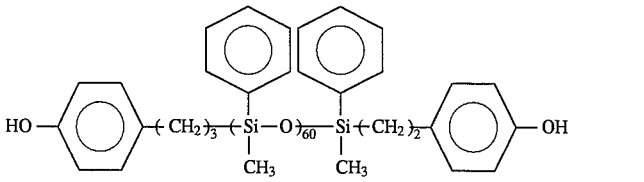

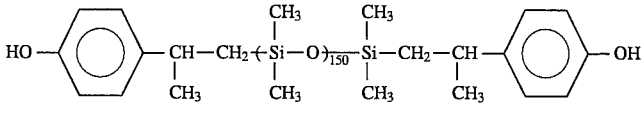

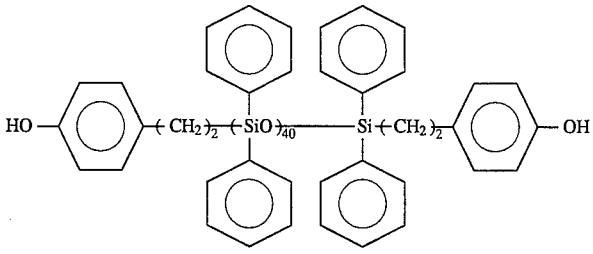

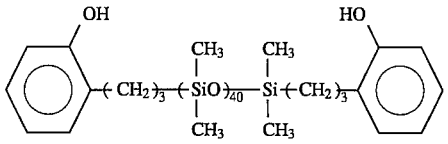

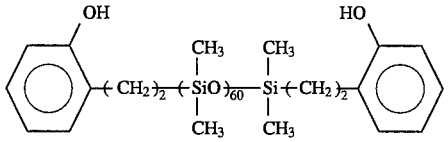

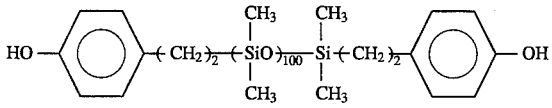

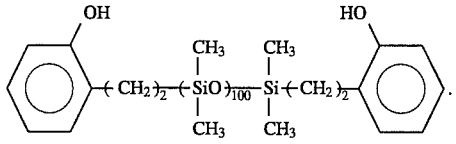

32. The developer according to claim 27, wherein the copolymer comprises a block copolymer unit of the following formula [3]:

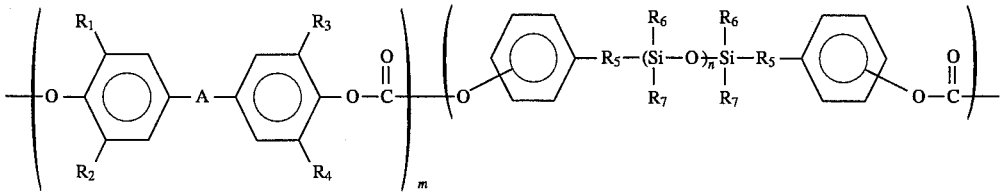

[3]

wherein $R_1$–$R_4$ and A are respectively the same as in the formula [1], $R_5$–$R_7$ and n are respectively the same as in the formula [2], and m is a positive integer.

33. The developer according to claim 27, wherein the magnetic material constitutes a carrier core.

34. The developer according to claim 33, wherein the carrier core of the magnetic material is coated with the copolymer having the structural units of the formulae [1] and [2].

35. The developer according to claim 33, wherein the carrier core has an average particle size of 5–100 μm.

36. The developer according to claim 35, wherein the carrier core comprises iron or iron oxide.

37. The developer according to claim 35, wherein the carrier are comprises ferrite.

38. The developer according to claim 33, wherein the carrier core is coated with the resin in an coating amount CW (wt. %) in the range of $1/2Z \leqq CW \leqq 50/Z$ with respect to a true specific gravity Z of the carrier core.

39. The developer according to claim 38, wherein the carrier core is coated with the resin in an coating amount CW (wt. %) in the range of $1/Z \leqq CW \leqq 25/Z$ with respect to a true specific gravity Z of the carrier core.

40. The developer according to claim 33, wherein the carrier core is coated with 0.01–30 wt. % of the resin.

41. The developer according to claim 27, wherein the copolymer has a weight-average molecular weight of $1\times10^4$–$10\times10^4$.

42. The developer according to claim 27, wherein said carrier has an electrical resistivity of $10^8$–$10^{14}$ ohm.cm.

43. The developer according to claim 27, wherein said carrier comprises magnetic material-dispersion type carrier particles each comprising the magnetic material dispersed within the resin.

44. The developer according to claim 43, wherein the magnetic material has a primary average particle size of at most 2.0 μm.

45. The developer according to claim 44, having an average particle size of 5–100 μm.

46. The developer according to claim 44, wherein the magnetic material has an electrical resistivity of at most $10^9$ ohm.cm.

47. The developer according to claim 43, wherein the magnetic material is contained in a proportion of at most 30 wt. %.

48. The developer according to claim 27, wherein the structural unit of the formula [1] is represented by the following formula:

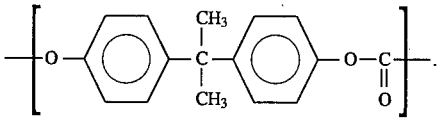

49. The developer according to claim 27, wherein the structural unit of the formula [1] is represented by the following formula:

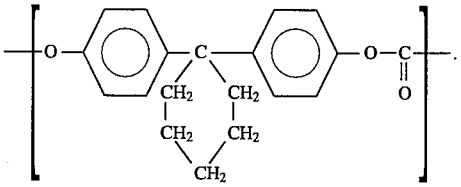

50. The developer according to claim 27, wherein the structural unit of the formula [1] is represented by the following formula:

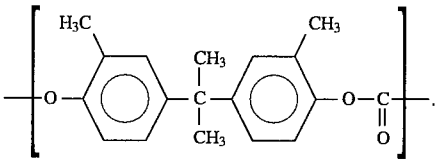

51. The developer according to claim 27, wherein the structural unit of the formula [1] is represented by the following formula:

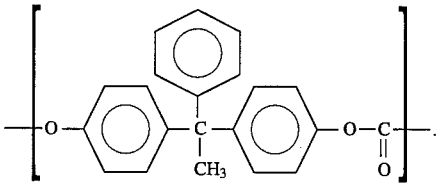

52. The developer according to claim 27, wherein the structural unit of the formula [1] is represented by the following formula:

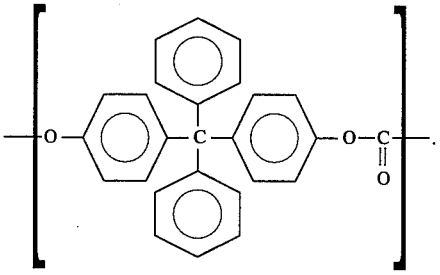

53. The developer according to claim 27, wherein the toner has a weight-average particle size of 1–20 μm.

54. The developer according to claim 53, wherein the toner has a weight-average particle size of 4–13 μm.

55. The developer according to claim 27, wherein the toner carries silica fine powder externally added thereto.

56. The developer according to claim 27, wherein the toner carries titanium oxide fine powder externally added thereto.

* * * * *